US010463121B2

(12) United States Patent
Lv

(10) Patent No.: US 10,463,121 B2
(45) Date of Patent: Nov. 5, 2019

(54) UMBRELLA AND METHOD FOR MANUFACTURING THE UMBRELLA

(71) Applicant: Sunbao Lv, QuanZhou (CN)

(72) Inventor: Sunbao Lv, QuanZhou (CN)

( * ) Notice: Subject to any disclaimer, the term of this patent is extended or adjusted under 35 U.S.C. 154(b) by 0 days.

(21) Appl. No.: 15/765,680

(22) PCT Filed: Aug. 23, 2016

(86) PCT No.: PCT/CN2016/096425
§ 371 (c)(1),
(2) Date: Apr. 3, 2018

(87) PCT Pub. No.: WO2017/059747
PCT Pub. Date: Apr. 13, 2017

(65) Prior Publication Data

US 2019/0082803 A1 Mar. 21, 2019

(30) Foreign Application Priority Data

Oct. 8, 2015 (CN) ..... 2015 1 0645532

(51) Int. Cl.

| | |
|---|---|
| ***A45B 25/18*** | (2006.01) |
| ***A45B 25/02*** | (2006.01) |
| ***A45B 15/00*** | (2006.01) |
| *A45B 11/00* | (2006.01) |

(52) U.S. Cl.
CPC ..... *A45B 25/18* (2013.01); *A45B 15/00* (2013.01); *A45B 25/02* (2013.01); *A45B 2011/005* (2013.01)

(58) Field of Classification Search
CPC ..... A45B 19/10; A45B 25/02; A45B 25/04; A45B 25/18
See application file for complete search history.

(56) References Cited

U.S. PATENT DOCUMENTS 404,039 A * 5/1889 Harris ..... A45B 25/18 135/33.5
1,603,084 A * 10/1926 Katz ..... A45B 25/18 135/33.2
2,543,359 A * 2/1951 Frost ..... A45B 25/18 135/33.5

(Continued)

FOREIGN PATENT DOCUMENTS

GB 1192676 A * 5/1970 ..... A45B 25/10

*Primary Examiner* — Noah Chandler Hawk
(74) *Attorney, Agent, or Firm* — Hauptman Ham, LLP

(57) ABSTRACT

The present disclosure provides an umbrella and a method for manufacturing the umbrella, and, the umbrella includes an umbrella frame, an umbrella cloth, and a plurality of positioning fasteners, the umbrella frame defines a plurality of installing portions matching to the positioning fasteners; the umbrella cloth define a plurality of avoiding holes corresponding to the installing portions; the positioning fastener includes a head part and a rod part, the rod parts of the positioning fasteners pass through the avoiding holes, to fasten with the installing portions, the umbrella cloth is clamped between the head parts of the positioning fasteners and the umbrella frame, to fix the umbrella cloth on the umbrella frame. The technical proposal of the present disclosure can improve the production efficiency of the umbrella.

8 Claims, 7 Drawing Sheets

(56) References Cited

U.S. PATENT DOCUMENTS

| | | | | | |
|---|---|---|---|---|---|
| 4,815,489 | A * | 3/1989 | Yang | A45B 19/10 | 135/25.3 |
| 5,806,546 | A * | 9/1998 | Ni | A45B 25/18 | 135/15.1 |
| 7,063,029 | B1 * | 6/2006 | Tsui | A45B 25/18 | 112/475.06 |
| 7,581,504 | B1 * | 9/2009 | Tsui | A45B 25/18 | 112/475.08 |
| 2003/0070699 | A1 * | 4/2003 | Lee | A45B 25/18 | 135/20.3 |

* cited by examiner

UMBRELLA AND METHOD FOR MANUFACTURING THE UMBRELLA

RELATED APPLICATIONS

The present application is a National Phase of International Application Number PCT/CN2016/096425, filed Aug. 23, 2016, and claims the priority of China Application No. 201510645532.5, filed Oct. 8, 2015.

FIELD OF THE DISCLOSURE

The present disclosure relates to the technology field of umbrella manufacturing, and in particular, to an umbrella, and a method for manufacturing the umbrella.

BACKGROUND OF THE DISCLOSURE

Currently in a process for producing umbrella, it needs to fix the umbrella cloth on the umbrella frame, the existing umbrella is manufactured by manually sewing the umbrella cloth to the umbrella frame, or by connecting the umbrella frame to connectors fixed at the inner side of the umbrella cloth, as the sewing operation and the connecting operation are both operated at the inner side of the umbrella cloth, it needs to be aligned and operated manually, which is time consuming and laborious, and cannot be automatically produced by mechanical equipments, thus resulting a very low production efficiency of the umbrella.

SUMMARY OF THE DISCLOSURE

The main aim of the present disclosure is to provide an umbrella, which aims to improve the production efficiency of the umbrella.

In order to achieve the above aim, the umbrella provided by the present disclosure includes an umbrella frame, an umbrella cloth, and a plurality of positioning fasteners; wherein, the umbrella frame is configured to define a plurality of installing portions matching to the positioning fasteners;

the umbrella cloth is configured to define a plurality of avoiding holes corresponding to the installing portions; and each of the positioning fasteners includes a head part and a rod part, the rod parts of the positioning fasteners respectively pass through corresponding avoiding holes, to fasten with corresponding installing portions, the umbrella cloth is clamped between the head parts of the positioning fasteners and the umbrella frame, to fix the umbrella cloth on the umbrella frame.

Preferably, the installing portions are through holes formed on the umbrella frame, an outer end of each of the rod parts of the positioning fasteners has a tapered shape, the middle part of each of the rod parts defines an external thread, the rod parts of the positioning fasteners respectively pass through corresponding avoiding holes, to fasten with corresponding installing portions.

Preferably, a waterproof pad is defined between each of the head parts of the positioning fasteners and the umbrella cloth.

Preferably, the umbrella cloth is an one piece umbrella cloth.

Preferably, the umbrella cloth is a spliced umbrella cloth.

Preferably, the umbrella frame includes a supporting rod, a sliding ring, a plurality of stretching rods, and a plurality of umbrella ribs;

the sliding ring is slideably located on the supporting rod;

each of the umbrella ribs includes a first folding rod, a second folding rod, and a third folding rod, one end of each of the first folding rods is connected with a tail end of one corresponding supporting rod, one end of each of the second folding rods is pivoted to the other end of one corresponding the first folding rod, the other end of each of the second folding rods is pivoted to one end of one corresponding third folding rod;

ends of the plurality of stretching rods are all connected with the sliding ring, the other ends of the plurality of stretching rods are respectively connected with corresponding first folding rods; and the middle part of the umbrella cloth is fixed on the top of the supporting rod, and the umbrella cloth covers the umbrella frame, the installing portions are defined on the umbrella frame.

Preferably, the umbrella cloth is an one piece umbrella cloth, the umbrella cloth defines a plurality of notches extending from a periphery of the umbrella cloth to the middle point of the umbrella cloth along a radial direction, the depth of the notch matches to the length of the third folding rod, the width of the notch is gradually enlarged toward the periphery of the umbrella cloth along the radial direction, two edges of each of the notches are sewed to fix together, allowing the umbrella cloth to have a bowl shape, each sewing thread for each of the notches has an outer end being fixed at an outer end of one corresponding third folding rod.

Preferably, the position of each of the first folding rods near the pivoting position of the first folding rod and the second folding rod defines one of the installing portion, the position of each of the third folding rod near the pivoting position of the third folding rod and the second folding rod defines another one of the installing portion.

Preferably, the position of each of the first folding rods near the pivoting position of the first folding rod and the second folding rod defines one of the installing portion, the umbrella cloth is fixed with the first folding rods through the positioning fasteners;

the third folding rods fixes with the umbrella cloth through sewing; or, each of the third folding rods defines a first connecting part, the umbrella cloth is defined second connecting parts at the inner side corresponding to the first connecting parts, the first connecting parts are connected with the second connecting parts, to fix the umbrella cloth with the third folding rods.

The present disclosure also provides a method for manufacturing an umbrella, the umbrella includes an umbrella frame, an umbrella cloth and a plurality of positioning fasteners; wherein, the umbrella frame is configured to define a plurality of installing portions matching to the positioning fasteners; the umbrella cloth is configured to define a plurality of avoiding holes corresponding to the installing portions; and each of the positioning fasteners includes a head part and a rod part, the rod parts of the positioning fasteners respectively pass through corresponding avoiding holes, to fasten with corresponding installing portions, the umbrella cloth is clamped between the head parts of the positioning fasteners and the umbrella frame, to fix the umbrella cloth on the umbrella frame; and the method for manufacturing the umbrella includes the following steps:

covering the umbrella frame by the umbrella cloth, and aligning the avoiding holes with the installing portions;

and, passing the rod parts of the positioning fasteners through the avoiding holes, to fasten the rod parts with the installing portions.

The technical proposal of the present disclosure adopts the positioning fasteners, and defines the installing portions corresponding to the positioning fasteners on the umbrella frame, the rod parts of the positioning fasteners respectively pass through corresponding avoiding hole of the umbrella cloth from the outside to the inside, and then fasten with corresponding installing portions, such that the head parts of the positioning fasteners press the outside surface of the umbrella cloth, therefore, the umbrella cloth fixes on the umbrella frame; the umbrella frame is firmly connected with the umbrella cover, and the setting mode of the positioning fasteners and the installing portions can enable that the fixing operation between the umbrella cloth and the umbrella frame can be operated at the outside of the umbrella cloth, further the fixing operation only relates to the locating of the umbrella cloth and the umbrella frame, and the fastening operation between the positioning fasteners and the installing portions, compared with the traditional mounting method including the sewing operation which is operated at the inner side of the umbrella cloth and the connecting operation of the connector located at the inner side of the umbrella cloth, as the locating operation and the fastening operation which are operated at the outside of the umbrella cloth are much simpler, and both of the operations can be finished by mechanical equipments, therefore, the production efficiency of the umbrella can be greatly improved.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only about some embodiments of the present disclosure, and persons of ordinary skill in the art can derive other drawings from the accompanying drawings without creative efforts.

LABELS ILLUSTRATION FOR DRAWINGS

TABLE 1

| Label | Name | Label | Name |
|---|---|---|---|
| 100 | umbrella frame | 200, 200', 200" | umbrella cloth |
| 300 | positioning fastener | 101 | installing portion |
| 120 | supporting rod | 140 | sliding ring |
| 160 | streching rod | 180 | umbrella rib |
| 182 | first folding rod | 184 | second folding rod |
| 184 | third folding rod | 201 | notch |
| 320 | head part | 340 | rod part |
| 360 | waterproof pad | | |

The realizing of the aim, functional characteristics, advantages of the present disclosure are further described in detail with reference to the accompanying drawings and the embodiments.

DETAILED DESCRIPTION OF THE EMBODIMENTS

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all the directional instructions of in the present disclosure (such as top, down, left, right, front, back . . . ) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

The present disclosure provides an umbrella.

Figure 1:
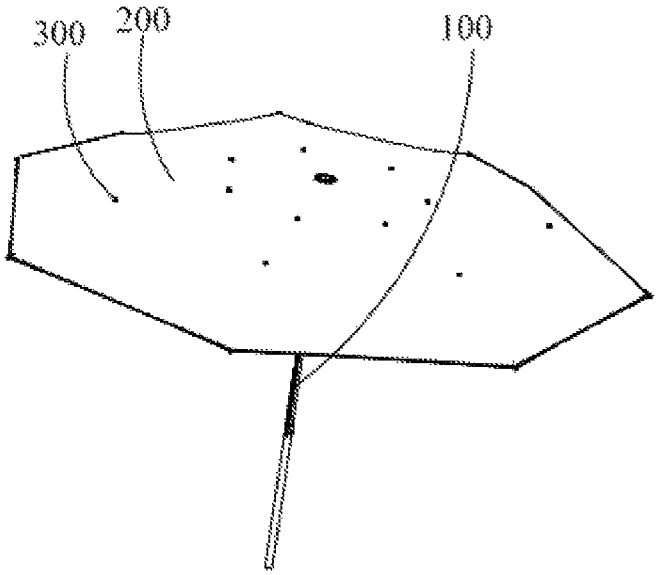
FIG. 1 is a structure diagram of an umbrella according to an exemplary embodiment of the present disclosure.
Figure 2:
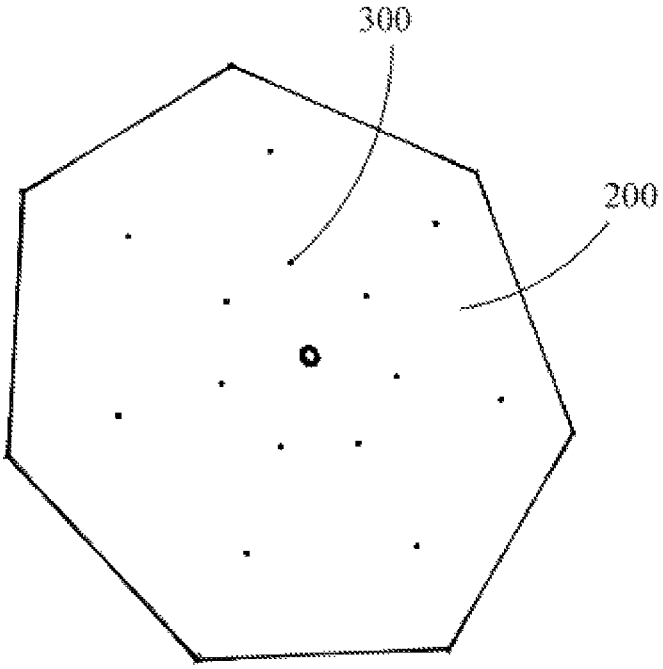
FIG. 2 is similar to FIG. 1, but shown from another aspect.
Figure 3:
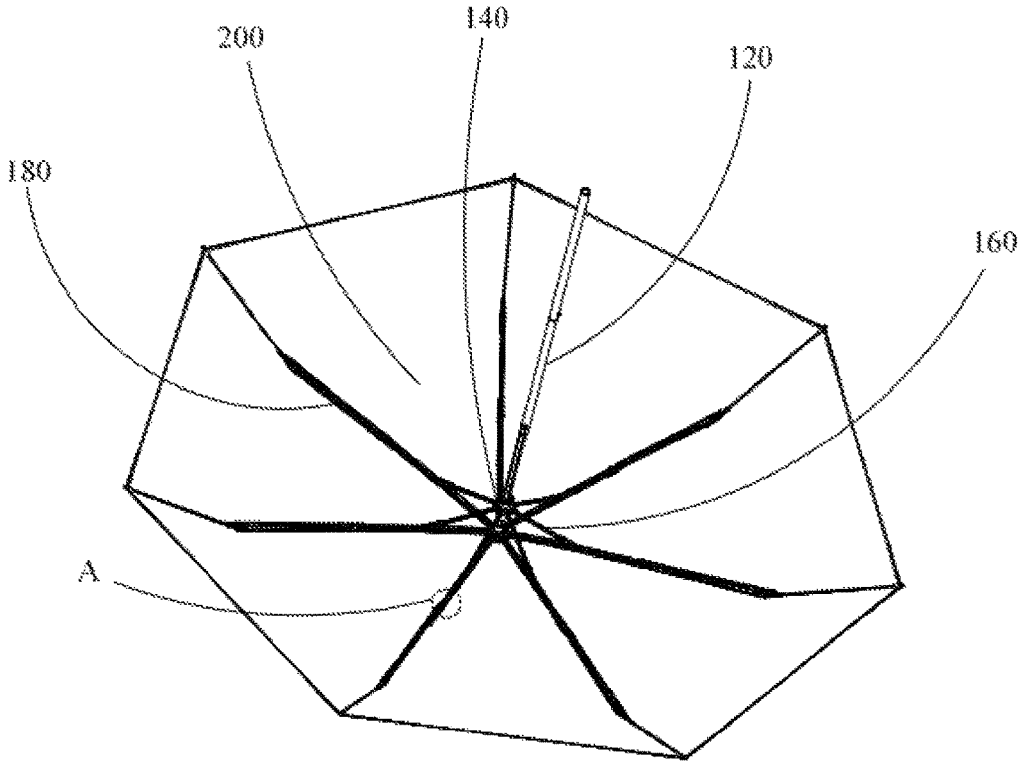
FIG. 3 is similar to FIG. 1, but shown from another aspect.
Figure 4:
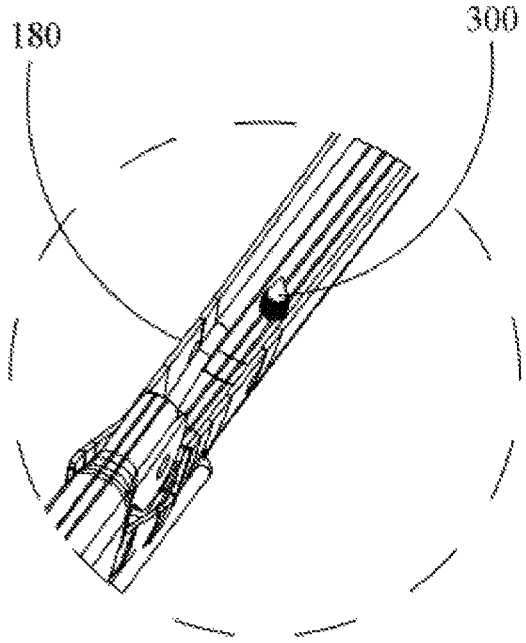
FIG. 4 is a partial enlarged diagram of part A shown in FIG. 3.
Figure 5:
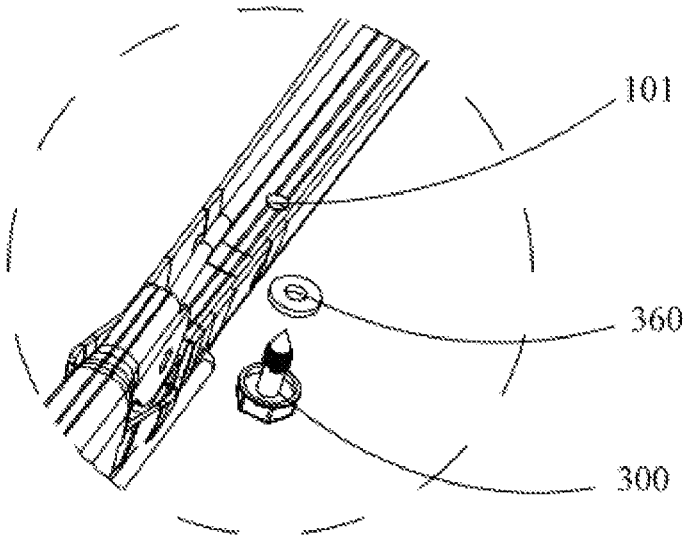
FIG. 5 is an exploded diagram of an umbrella rib and a positioning fastener shown in FIG. 4.
Figure 6:
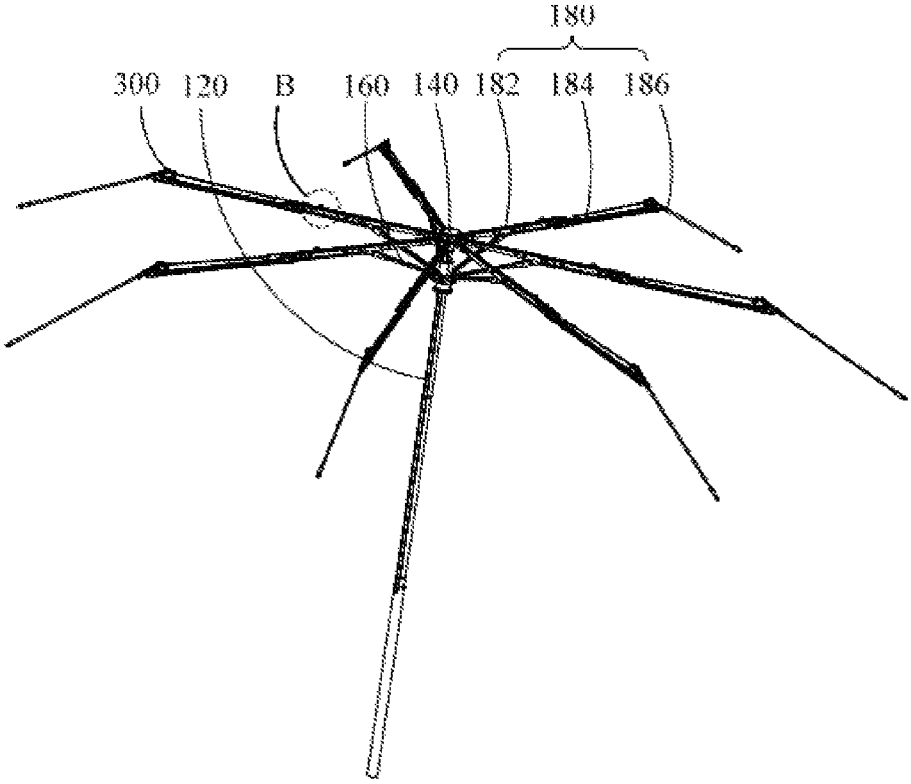
FIG. 6 is a structure diagram of an umbrella frame and the positioning fastener of the umbrella shown in FIG. 2.
Figure 7:
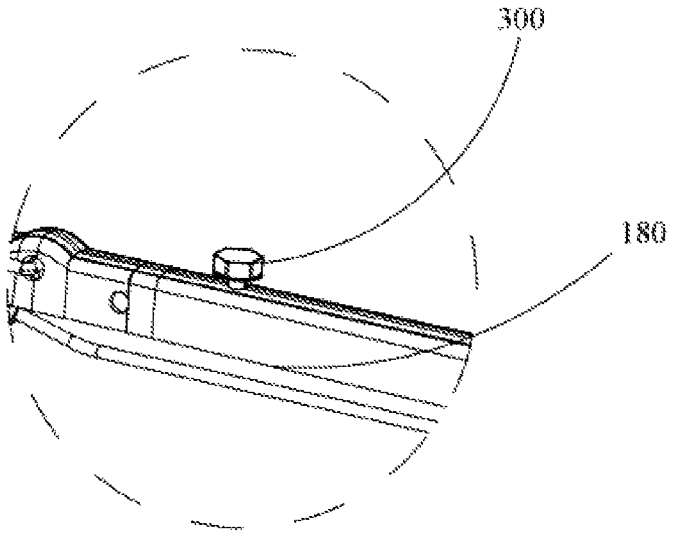
FIG. 7 is a partial enlarged diagram of part B shown in FIG. 6.
Figure 8:
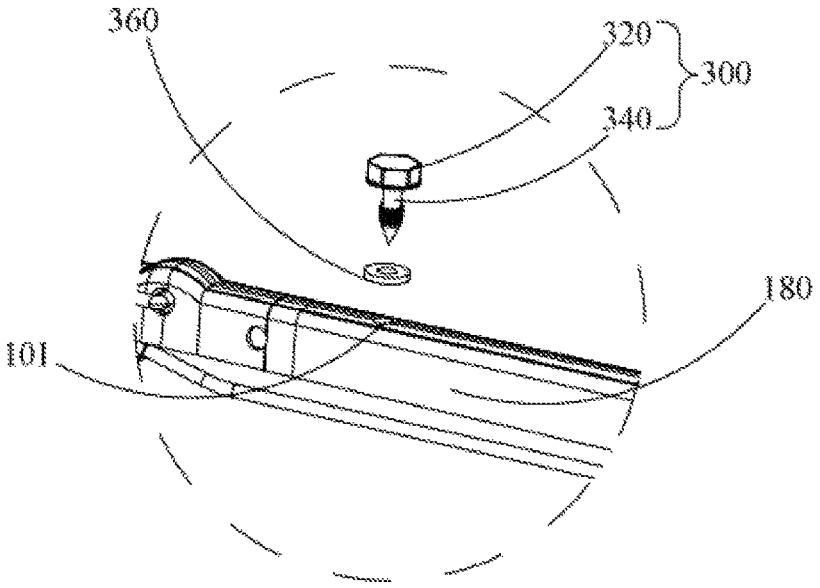
FIG. 8 is an exploded diagram of the umbrella frame and the positioning fastener shown in FIG. 7.
Figure 9:
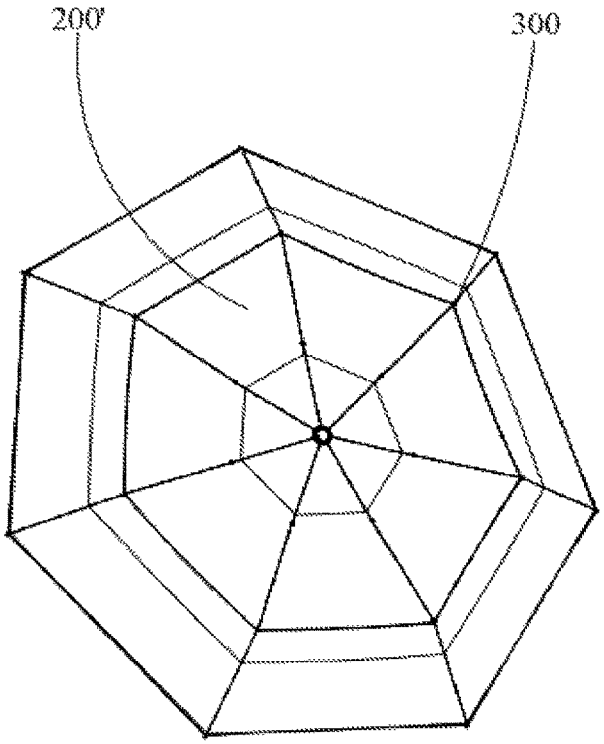
FIG. 9 is a structure diagram of the umbrella according to another exemplary embodiment of the present disclosure.
Figure 10:
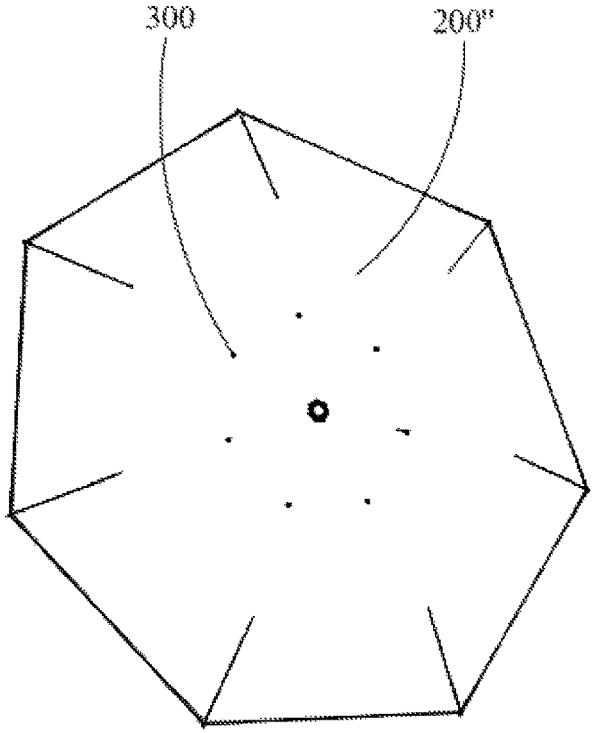
FIG. 10 is a structure diagram of the umbrella according to another exemplary embodiment of the present disclosure.
Figure 11:
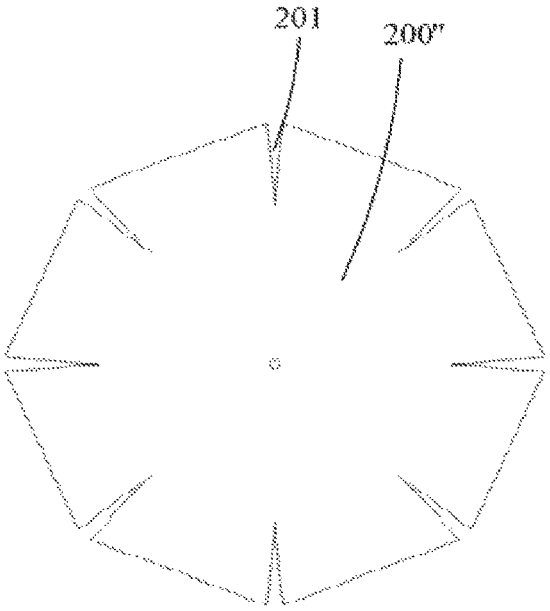
FIG. 11 is a structure diagram of an unsewed umbrella cloth shown in FIG. 10.

Referring to FIGS. 1-11, FIG. 1 is a structure diagram of the umbrella according to an exemplary embodiment of the present disclosure; FIG. 2 is similar to FIG. 1, but shown from another aspect; FIG. 3 is similar to FIG. 1, but also shown from another aspect; FIG. 4 is a partial enlarged diagram of part A shown in FIG. 3; FIG. 5 is an exploded diagram of an umbrella rib and a positioning fastener shown in FIG. 4; FIG. 6 is a structure diagram of an umbrella frame and the positioning fastener of the umbrella shown in FIG. 2; FIG. 7 is a partial enlarged diagram of part B shown in FIG. 6; FIG. 8 is an exploded diagram of the umbrella frame and the positioning fastener shown in FIG. 7; FIG. 9 is a structure diagram of the umbrella according to another exemplary embodiment of the present disclosure; FIG. 10 is a structure diagram of the umbrella according to another exemplary embodiment of the present disclosure; FIG. 11 is a structure diagram of an unsewed umbrella cloth shown in FIG. 10.

Referring to FIGS. 1-3, in the exemplary embodiment of the present disclosure, the umbrella includes an umbrella frame 110, an umbrella cloth 200 and a plurality of positioning fasteners 300; the umbrella frame 100 defines a plurality of installing portions 101 matching to the positioning fasteners 300; the umbrella cloth 200 (referring to FIGS. 5 and 8, and combining with FIGS. 4 and 7 to understand) are configured to define a plurality of avoiding holes (not shown) corresponding to the installing portions 101; each of the positioning fasteners 300 includes a head part 320 (referring to FIGS. 5 and 8, and combining with FIGS. 4 and 7 to understand) and a rod part 340 (referring to FIGS. 5 and 8, and combining with FIGS. 4 and 7 to understand), after the rod parts 340 of the positioning fasteners 300 pass through the corresponding avoiding holes, the rod parts 340 fasten with corresponding installing portions 101, such that, the umbrella cloth 200 is clamped between the head parts 320 of the positioning fasteners 300 and the umbrella frame 100, so as to fix the umbrella cloth 200 on the umbrella frame 100.

The technical proposal of the present disclosure adopts the positioning fasteners 300, and defines the installing portions 101 corresponding to the positioning fasteners 300 on the umbrella frame 100, the rod parts 340 of the positioning fasteners 300 respectively pass through corresponding avoiding hole of the umbrella cloth 200 from the outside to the inside, and then fasten with corresponding installing portions 101, such that the head parts 320 of the positioning fasteners 300 press the outside surface of the umbrella cloth 200, therefore, the umbrella cloth 200 fixes on the umbrella frame 100; the umbrella frame 100 is firmly connected with the umbrella cover, and the setting mode of the positioning fasteners 300 and the installing portions 101 can enable that the fixing operation between the umbrella cloth 200 and the umbrella frame 100 can be operated at the outside of the umbrella cloth 200, further the fixing operation only relates to the locating of the umbrella cloth 200 and the umbrella frame 100, and the fastening operation between the positioning fasteners 300 and the installing portions 101, compared with the traditional mounting method including the sewing operation which is operated at the inner side of the umbrella cloth 200 and the connecting operation of the connector located at the inner side of the umbrella cloth 200, as the locating operation and the fastening operation which are operated at the outside of the umbrella cloth 200 are much simpler, and both of the operations can be finished by mechanical equipments, therefore, the production efficiency of the umbrella can be greatly improved.

The setting mode of the positioning fasteners 300 and the installing portions 101 can be variety, such as, the installing portion 101 is a deep hole, the rod part 340 of the positioning fastener 300 can be engaged in the deep hole in an interference fit mode, and then, fix with the deep hole through adhesive; or, the installing portion 101 is a mounting hole, the outer end of the rod part 340 of the positioning fastener 300 can define a plurality of clips, each clip has a leading surface, each clip extends into one corresponding mounting hole by the function of the leading surface and clamps at a periphery of a side of the mounting hole which is away from the umbrella cloth 200; or, the installing portion 101 is a bolt with a leading surface, the outer end of the rod part 340 of the positioning fastener 300 defines a matching hole corresponding to the bolt, the rod part 340 of the positioning fastener 300 coils around the bolt through the matching hole. In the exemplary embodiment, preferably, the installing portion 101 is through hole formed on the umbrella frame 100, the outer end of the rod part 340 of the positioning fastener 300 has a tapered shape, the middle part of each of the rod part 340 defines an outer thread, the rod parts 340 of the positioning fasteners 300 respectively pass through corresponding avoiding holes, and then fasten with corresponding installing portions 101. In the exemplary embodiment, the outer end of the rod part 340 of the positioning fastener 300 has the tapered shape, such that, it is more beneficial to pass through the umbrella cloth 200 and form the avoiding holes on the umbrella cloth 200, it does not need to form the avoiding holes on the umbrella cloth 200 beforehand, and the rod parts 340 can pass through the umbrella cloth 200 by rotating, therefore, the rod parts 340 would not harm the cloth, therefore, pulling yarn, breaking yarn, etc, can be avoided. As the thread is set, and the umbrella frame is relatively thin, the thickness of the through hole is normally smaller than the pitch of the thread, the positioning fastener 300 can rotate into the through hole and fasten with the through hole, the reliability of the fastening structure is much better. In order to make the positioning fasteners 300 rotate much smoother, and ensure the fastening effect between the positioning fasteners 300 and the through holes much better, furthermore, the aperture of the through hole and the diameter of the rod part 340 are equality, or the aperture of the through hole is slightly larger than the diameter of the rod part 340.

As the umbrella cloth 200 defines the avoiding holes, rainwater may flow into the umbrella cloth 200 through the avoiding holes, which causes the umbrella cloth 200 leaking, referring to FIGS. 5 and 8, and combining with FIGS. 3, 4, 6 and 7 to understand, preferably, a waterproof pad 360 is defined between each of the head parts 320 of the positioning fasteners 300 and the umbrella cloth 200. The waterproof pad 360 has a ring shape, and coils around the rod part 340, which can prevent water flowing into the inner side of the umbrella cloth 200 through the avoiding holes of the umbrella cloth 200, the waterproof pad 360 can be made of soft materials, such as rubber, etc.

Referring to FIGS. 1-3, preferably, the umbrella cloth 200 is an one piece umbrella cloth 200. The umbrella cloth 200 is an one piece umbrella cloth, as the one piece umbrella cloth 200 is made by a molding technology, the umbrella cloth 200 does not have spliced seam, so rainwater can not penetrate into the umbrella cloth 200, the waterproof effect is good. In order to adapt to the shape of the umbrella, it is necessary to set the one piece umbrella cloth 200 to have the bowl type.

Referring to FIG. 9, in another exemplary embodiment of the present disclosure, preferably, the umbrella cloth 200' is a spliced umbrella cloth. The spliced umbrella cloth is formed by sewing a plurality of triangular umbrella cloth together, which is the most common umbrella cloth type, and the spliced umbrella cloth can adapt to the shape of the umbrella very well, and form the umbrella cover with different radians, the spliced umbrella cloth can also be applied in the present disclosure, at this time, the avoiding holes are preferably formed at the seaming line of the spliced umbrella cloth.

Referring to FIGS. 3 and 6, preferably, the umbrella frame 100 includes a supporting rod 120, a sliding ring 140, a plurality of stretching rods 160, and a plurality of umbrella ribs 180, the sliding ring 140 is slideably located on the supporting rod 120, each of the umbrella ribs 180 includes a first folding rod 182, a second folding rod 184 and a third folding rod 186, one end of each of the first folding rods 182 is connected with a tail end of one corresponding supporting rod 120, one end of each of the second folding rods 184 is pivoted to the other end of one corresponding first folding rod 182, the other end of each of the second folding rods 184 is pivoted to one end of one corresponding third folding rob 186, an end of each of the stretching rods 160 is connected with the sliding ring 140, the other end of each of the stretching rods 160 is connected with corresponding first folding rod 182, the middle part of the umbrella cloth 200 is fixed with the top of the supporting rod 120 and the umbrella cloth 200 covers the outside of the umbrella rib 180, the installing portions 101 are all defined on the umbrella rib 180. The umbrella cloth 200 contacts with the umbrella rib 180 of the umbrella frame 100, and the installing portions 101 are defined on the umbrella rib 180, so as to adapt to the mounting requirement between the umbrella cloth 200 and the umbrella frame 100; more specifically, in the exemplary embodiment, the installing portions 101 are through holes formed on the umbrella frame 180 and extending inwardly from a surface facing the umbrella cloth 200.

Referring to FIGS. 10 and 11, and combining with FIG. 6 to understand, preferably, in another exemplary embodiment of the present disclosure, the umbrella cloth 200 is an one piece umbrella cloth 200", the umbrella cloth 200 defines a plurality of notches 201 extending from a periphery of the umbrella cloth 200 to the middle part of the umbrella cloth 200 along the radial direction, the depth of the notch 201 matches to the length of the third folding rod 186, the width of the notch 201 is gradually enlarged toward the periphery of the umbrella cloth 200 along the radial direction, two edges of each of the notch 201 are sewed to together, so as to make the umbrella cloth 200 to have the bowl shape, each sewing thread for each of the notches has an outer end being fixed at an outer end of one corresponding third folding rod 186. The one piece umbrella cloth 200 can have the bowl shape by setting the notches 201 and sewing the notches 201, therefore, the umbrella cloth 200 can adapt to the shape of the umbrella much better.

The setting positions of the installing portions 101 can be selected according to reality, referring to FIG. 6, in the exemplary embodiment, preferably, the position of each of the first folding rods 182 near the pivoting position of the first folding rod 182 and the second folding rod 184 defines one installing portion 101, the position of each of the third folding rods 186 near the pivoting position of the third folding rod 186 and the second folding rod 184 defines another one installing portion 101, each umbrella rib 180 defines two installing portions 101, which respectively realize the fixing between the first folding rods 182 and the umbrella cloth 200, and the fixing between the third folding rods 186 and the umbrella cloth 200, and then the umbrella cloth 200 can be reliably mounted on the umbrella rib 180.

The setting positions of the installing portions 101 cannot be limited in the above exemplary embodiment, combining with the FIG. 10 to understand, in another exemplary embodiment of the present disclosure, preferably, the position of each of the first folding rods 182 near the pivoting position of the first folding rod 182 and the second folding rod 184 defines one installing portion 101, the umbrella cloth 200 is fixed with the first folding rods 182 through the positioning fasteners 300; while the fixing mode of the third folding rod 186 can be selected one from the fixing modes in the existing technology, such as, the third folding rods 186 fixes with the umbrella cloth 200 through sewing; or, each of the third folding rods 186 defines a first connecting part (not shown), the inner side of the umbrella cloth 200 is defined a plurality of second connecting parts corresponding to the first connecting parts (not shown), the second connecting parts are connected with the first connecting parts, so as to fix the umbrella cloth 200 with the third folding rods 186. Although, in the exemplary embodiment, only the first folding rod 182 defines the installing portion 101, while in a certain degree, the mounting efficiency is improved, simultaneously, fixing the third folding rod 186 with the umbrella cloth 200 adopts the traditional fixing mode, which can also have the advantage of the traditional fixing mode.

Figure 12:
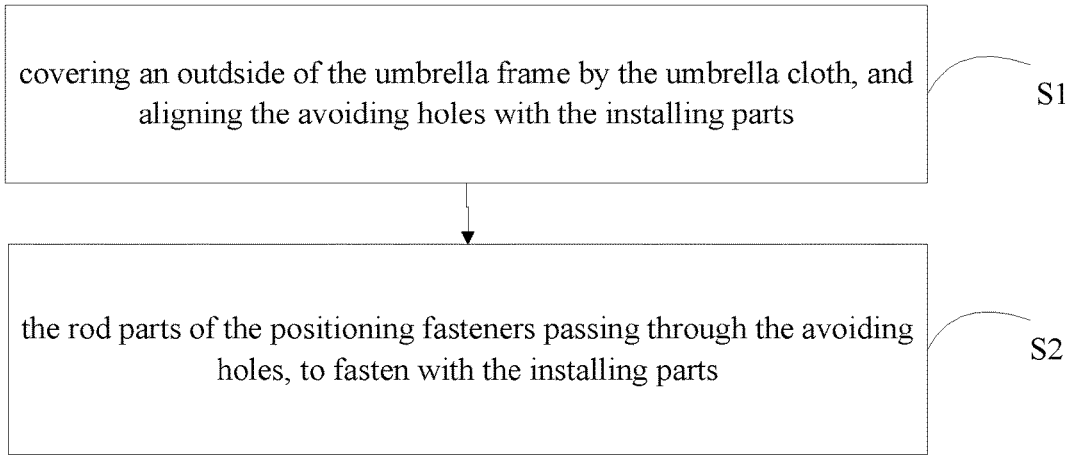
FIG. 12 is a flowchart of a method for manufacturing the umbrella of the present disclosure.

Referring to FIG. 12, the present disclosure also provides a method for manufacturing an umbrella, the detail structure of the umbrella can be referred to the above exemplary embodiments, as the umbrella adopts all the technical proposal of the above exemplary embodiments, the umbrella at least has all of the beneficial effects of the technical proposal of the above exemplary embodiments, the method for manufacturing the umbrella includes:

S1, the umbrella cloth 200 is defined to cover the umbrella frame 100, and the avoiding holes are defined to align with the installing portions 101;

S2, after the rod parts 340 of the positioning fasteners 300 pass through the avoiding holes, the rod parts 340 fasten with the installing portions 101.

The fixing of the umbrella cloth 200 and the umbrella frame 100 can be operated at the outside of the umbrella cloth 200, such that the method is simple and easy to be achieved, and, the aligning operation and covering operation of S1 can be finished by mechanical equipments, the fastening operation can also be finished by mechanical equipment, therefore, the production efficiency of the umbrella of the present disclosure is greatly improved.

The embodiments above are preferably embodiments of the present disclosure, and the present disclosure is not limited to such embodiments, equivalent structure conversion based on the specification and the drawing of the present disclosure, or directly or indirectly used in other related technical field, both similarly within the protection scope of the present disclosure.

What is claimed is:

1. An umbrella, comprising an umbrella frame, an umbrella cloth, and a plurality of positioning fasteners; wherein, the umbrella frame is configured to define a plurality of installing portions matching to the positioning fasteners;

the umbrella cloth is configured to define a plurality of avoiding holes corresponding to the installing portions;

each of the positioning fasteners comprises a head part and a rod part, the rod parts of the positioning fasteners pass through corresponding avoiding holes, to fasten with corresponding installing portions, the umbrella cloth is clamped between the head parts of the positioning fasteners and the umbrella frame, to fix the umbrella cloth on the umbrella frame;

the umbrella frame comprises a supporting rod, a sliding ring, a plurality of stretching rods, and a plurality of umbrella ribs;

the sliding ring is slideably located on the supporting rod;

each of the umbrella ribs comprises a first folding rod, a second folding rod, and a third folding rod, one end of each of the first folding rods is connected with a tail end of one corresponding supporting rod, one end of each of the second folding rods is pivoted to the other end of one corresponding the first folding rod, the other end of each of the second folding rods is pivoted to one end of one corresponding third folding rod;

ends of the plurality of stretching rods are all connected with the sliding ring, the other ends of the plurality of stretching rods are respectively connected with corresponding first folding rods;

the middle part of the umbrella cloth is fixed on the top of the supporting rod, and the umbrella cloth covers the umbrella frame, the installing portions are defined on the umbrella frame; and the umbrella cloth is an one piece umbrella cloth, the umbrella cloth defines a plurality of notches extending from a periphery of the umbrella cloth to the middle point of the umbrella cloth along a radial direction, the depth of the notch matches to the length of the third folding rod, the width of the notch is gradually enlarged toward the periphery of the umbrella cloth along the radial direction, two edges of each of the notches are sewed to fix together, allowing the umbrella cloth to have a bowl shape, each sewing thread for each of the notches has an outer end being fixed at an outer end of one corresponding third folding rod.

2. The umbrella according to claim 1, wherein, the installing portions are through holes formed on the umbrella frame, an outer end of each of the rod parts of the positioning fasteners has a tapered shape, the middle part of each of the rod parts defines an external thread, the rod parts of the positioning fasteners respectively pass through corresponding avoiding holes, to fasten with corresponding installing portions.

3. The umbrella according to claim 1, wherein, a waterproof pad is defined between each of the head parts of the positioning fasteners and the umbrella cloth.

4. The umbrella according to claim 1, wherein, the umbrella cloth is an one piece umbrella cloth.

5. The umbrella according to claim 1, wherein, the umbrella cloth is a spliced umbrella cloth.

6. The umbrella according to claim 1, wherein, the position of each of the first folding rods near the pivoting position of the first folding rod and the second folding rod defines one of the installing portion, the position of each of the third folding rod near the pivoting position of the third folding rod and the second folding rod defines another one of the installing portion.

7. The umbrella according to claim 1, wherein, the position of each of the first folding rods near the pivoting position of the first folding rod and the second folding rod defines one of the installing portion, the umbrella cloth is fixed with the first folding rods through the positioning fasteners;

the third folding rods fixes with the umbrella cloth through sewing; or, each of the third folding rods defines a first connecting part, the umbrella cloth is defined second connecting parts at the inner side corresponding to the first connecting parts, the first connecting parts are connected with the second connecting parts, to fix the umbrella cloth with the third folding rods.

8. A method for manufacturing an umbrella, the umbrella comprising an umbrella frame, an umbrella cloth, and a plurality of positioning fasteners; wherein, the umbrella frame is configured to define a plurality of installing portions matching to the positioning fasteners; the umbrella cloth is configured to define a plurality of avoiding holes corresponding to the installing portions; and each of the positioning fasteners comprises a head part and a rod part, the rod parts of the positioning fasteners pass through corresponding avoiding holes, to fasten with corresponding installing portions, the umbrella cloth is clamped between the head parts of the positioning fasteners and the umbrella frame, to fix the umbrella cloth on the umbrella frame, the umbrella frame comprises a supporting rod, a sliding ring, a plurality of stretching rods, and a plurality of umbrella ribs;

the sliding ring is slideably located on the supporting rod;

each of the umbrella ribs comprises a first folding rod, a second folding rod, and a third folding rod, one end of each of the first folding rods is connected with a tail end of one corresponding supporting rod, one end of each of the second folding rods is pivoted to the other end of one corresponding the first folding rod, the other end of each of the second folding rods is pivoted to one end of one corresponding third folding rod;

ends of the plurality of stretching rods are all connected with the sliding ring, the other ends of the plurality of stretching rods are respectively connected with corresponding first folding rods;

the middle part of the umbrella cloth is fixed on the top of the supporting rod, and the umbrella cloth covers the umbrella frame, the installing portions are defined on the umbrella frame; and the umbrella cloth is an one piece umbrella cloth, the umbrella cloth defines a plurality of notches extending from a periphery of the umbrella cloth to the middle point of the umbrella cloth along a radial direction, the depth of the notch matches to the length of the third folding rod, the width of the notch is gradually enlarged toward the periphery of the umbrella cloth along the radial direction, two edges of each of the notches are sewed to fix together, allowing the umbrella cloth to have a bowl shape, each sewing thread for each of the notches has an outer end being fixed at an outer end of one corresponding third folding rod, the method comprising the following steps: covering the umbrella frame by the umbrella cloth, and aligning the avoiding holes with the installing portions; and, passing the rod parts of the positioning fasteners through the avoiding holes, to fasten the rod parts with the installing portions.

* * * * *